US012721423B2

(12) United States Patent
Hwang

(10) Patent No.: US 12,721,423 B2
(45) Date of Patent: Sep. 1, 2026

(54) MAKEUP BRUSH

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 256 days.

(21) Appl. No.: 18/685,809

(22) PCT Filed: Oct. 7, 2022

(86) PCT No.: PCT/KR2022/015145
§ 371 (c)(1),
(2) Date: Feb. 22, 2024

(87) PCT Pub. No.: WO2023/063658
PCT Pub. Date: Apr. 20, 2023

(65) Prior Publication Data

US 2024/0349881 A1 Oct. 24, 2024

(30) Foreign Application Priority Data

Oct. 12, 2021 (KR) ..... 10-2021-0135270

(51) Int. Cl.
*A46B 7/04* (2006.01)
*A46B 9/02* (2006.01)

(52) U.S. Cl.
CPC ..... *A46B 7/04* (2013.01); *A46B 9/021* (2013.01); *A46B 2200/1046* (2013.01)

(58) Field of Classification Search
CPC ..... A46B 7/04; A46B 9/021; A46B 5/0095; A46B 3/08; A46B 3/10; B43K 23/016
See application file for complete search history.

(56) References Cited

U.S. PATENT DOCUMENTS

2017/0181534 A1* 6/2017 Hwang ..... A46D 3/00

FOREIGN PATENT DOCUMENTS

| | | | | |
|---|---|---|---|---|
| JP | 2011173433 A | * | 9/2011 | |
| JP | 2015-196088 A | | 11/2015 | |
| KR | 200448005 Y1 | * | 3/2010 | ..... B43K 19/00 |
| KR | 10-2019-0009443 A | | 1/2019 | |

* cited by examiner

*Primary Examiner* — Shay Karls
(74) *Attorney, Agent, or Firm* — Heedong Chae; Lucem, PC

(57) ABSTRACT

A makeup brush is disclosed. The makeup brush of the present disclosure comprises: a brush body having a handle body provided as a handle for a user, and a coupling body provided at the handle body; a brush bristle part, which is coupled to the brush body and has bristle members; and a connection fixing part having one side portion coupled to the coupling body, and having the other side portion supporting the bristle members and encompassing the coupling body, wherein the coupling body has a first cut part so as to guide the extension and contraction of the coupling body when the brush bristle part is coupled to the coupling body, and the brush bristle part is detachably coupled to the coupling body.

4 Claims, 10 Drawing Sheets

MAKEUP BRUSH

CROSS-REFERENCE TO RELATED APPLICATIONS

This application claims the priority of Korean Patent Application No. 10-2021-0135270 filed on Oct. 12, 2021, in the Korean Intellectual Property Office, the disclosure of which is incorporated herein by reference.

BACKGROUND OF THE INVENTION

Field of the Invention

The present disclosure relates to a makeup brush, and more particularly, to a makeup brush in which a finished product can be assembled without using adhesives in the process of manufacturing the brush, and each component can be conveniently replaced.

Description of the Related Art

Cosmetics generally used for makeup come in the form of liquid, solid, or a mixture of liquid and solid. Brushes of various shapes and sizes have been developed and used to apply solid cosmetics to the face.

That is, the brush described above is prepared so that cosmetics made of solid powder can be applied to the face, etc. by putting cosmetics on the bristles of the brush. These brushes include a handle that the user can hold with his or her hand, and a brush provided at the tip of the handle and made up of a plurality of bristles.

Previously, brushes were coupled o the handle using chemicals such as an adhesive. In this case, the adhesive is made of chemicals and can have a harmful effect on the human body, and taking this into consideration, if an adhesive that is harmless to the human body is used, the manufacturing cost increases.

And since the adhesive is a material that is vulnerable to heat, there is a problem in that the adhesive part falls off when exposed to heat, reducing durability.

The above-described technical configuration is a background technique for assisting the understanding of the present disclosure, and does not mean a conventional technology widely known in the art to which the present disclosure belongs.

SUMMARY OF THE INVENTION

Accordingly, a technical object achieved by the present disclosure is to provide a makeup brush in which a finished product can be assembled without using adhesives in the process manufacturing the brush, and each component can be of conveniently replaced.

According to an aspect of the present disclosure, there may be provided a makeup brush which includes: a brush body having a handle body provided as a handle for a user, and a coupling body provided at the handle body; a brush bristle part, which is coupled to the brush body and has bristle members; and a connection fixing part having one side portion coupled to the coupling body, and having the other side portion supporting the bristle members and encompassing the coupling body, in which the coupling body has a first cut part so as to guide the extension and contraction of the coupling body when the brush bristle part is coupled to the coupling body, and the brush bristle part is detachably coupled to the coupling body.

Further, according to another aspect of the present disclosure, there may be provided a makeup brush which includes: a brush body having a handle body provided as a handle for a user, and a coupling body provided at the handle body; a brush bristle part, which is coupled to the brush body and has bristle members; and a connection fixing part having one side portion coupled to the coupling body, and having the other side portion pressing an upper portion of the coupling body, in which the coupling body includes a second cut part guiding extension and contraction of a coupling area of the coupling body when detachably coupling the coupling body to the handle body, and a third cut part guiding extension and contraction of the coupling area of the coupling body when detachably coupling the brush bristle part to the coupling body, and the brush bristle part is detachably coupled to the coupling body.

The coupling body may further include a first screw thread provided on an outer wall of the coupling body, and a first step part provided at an upper end portion of the coupling body, and supporting an inner wall of the connection fixing part.

A plurality of first step parts may be provided, which are cut by the first cut part.

One side portion of the connection fixing part may be supported on a protrusion provided in the handle body, and the other side portion may be supported on the first step part.

The connection fixing part may be screwed to the coupling body.

The coupling body may further include a first body detachably coupled to the handle body, and having the second cut part, a screw thread body provided at one side portion of the first body, and a second body provided at one side portion of the screw thread body, detachably coupled to the brush bristle part, and having the third cut part.

The coupling body may include a second step part provided in the first body, and supporting one inner wall of the connection fixing part, and a third step part provided in the second body, and supporting the other inner wall of the connection fixing part.

A plurality of second step parts may be provided, which are cut by the second cut part, and a plurality of third step parts may be provided, which are cut by the third cut part.

Embodiments of the present disclosure can fundamentally block harmful components of adhesives.

In addition, the connection fixing part is coupled to the brush body while covering the coupling body, thereby increasing the stability of the coupling.

Furthermore, since the brush bristles are detachable from the coupling body, the brush bristles can be easily replaced.

In addition, the upper end of the coupling body can support the outside of the plurality of bristle members, thereby preventing the plurality of bristle members from spreading.

In addition, the brush bristles, the connection fixing part (metal tube), and the coupling body can be selectively detached, so the consumer can freely change the handle body of a desired color, the brush bristles, and the connection fixing part made of metal, paper, plastic, etc., which can be conveniently separated and collected after use.

DETAILED DESCRIPTION OF THE PREFERRED EMBODIMENT

Figure 1:
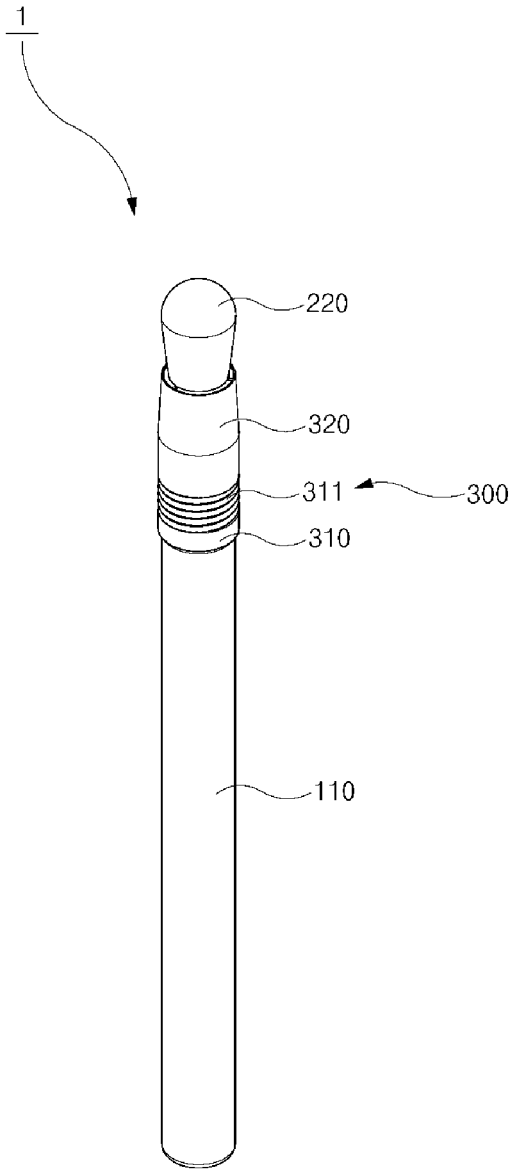
FIG. 1 is a diagram schematically illustrating a makeup brush according to an exemplary embodiment of the present disclosure.

In order to sufficiently appreciate the present disclosure, operational advantages of the present disclosure, objects achieved by exemplary embodiments the present disclosure, accompanying drawings illustrating the exemplary embodiments of the present disclosure and contents disclosed in the accompanying drawings should be referred.

Hereinafter, by describing a preferred exemplary embodiment of the present disclosure with reference to the accompanying drawings, the present disclosure will be described in detail. Like reference numerals illustrated in the respective drawings designate like members.

Figure 2:
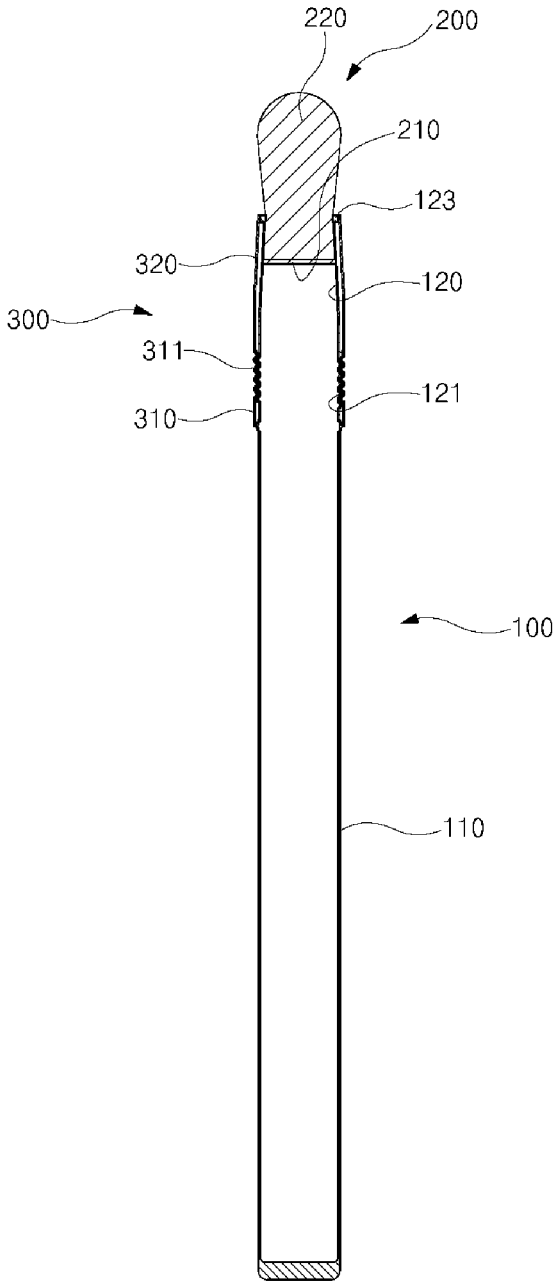
FIG. 2 is a cross-sectional view of FIG. 1.
Figure 3:
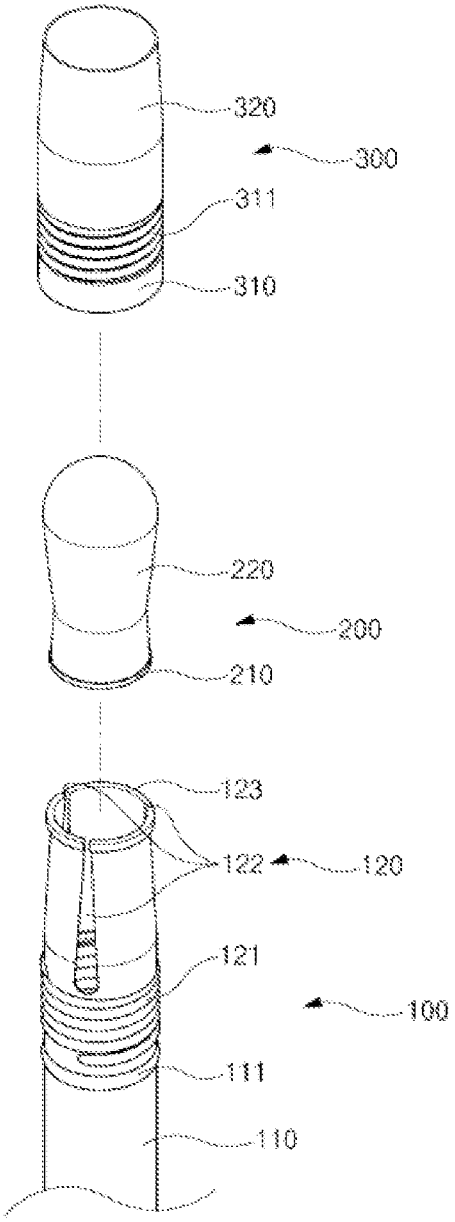
FIG. 3 is an exploded perspective view of FIG. 1.
Figure 4:
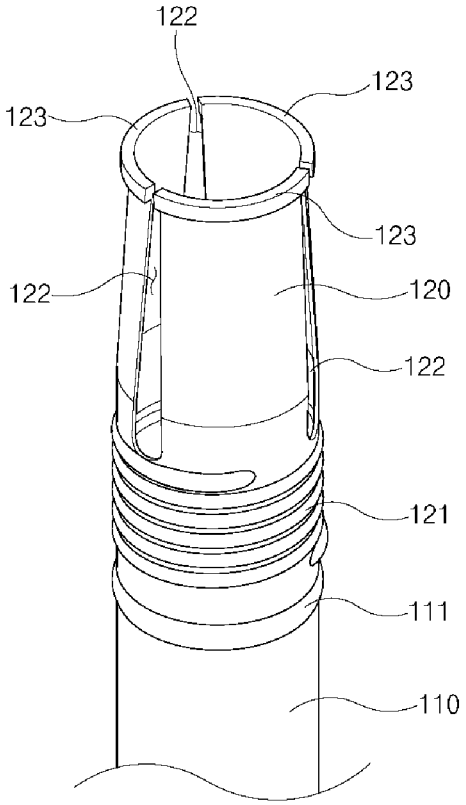
FIG. 4 is an enlarged view of an area of a coupling body illustrated in FIG. 3.
Figures 5A, 5B, 5C:
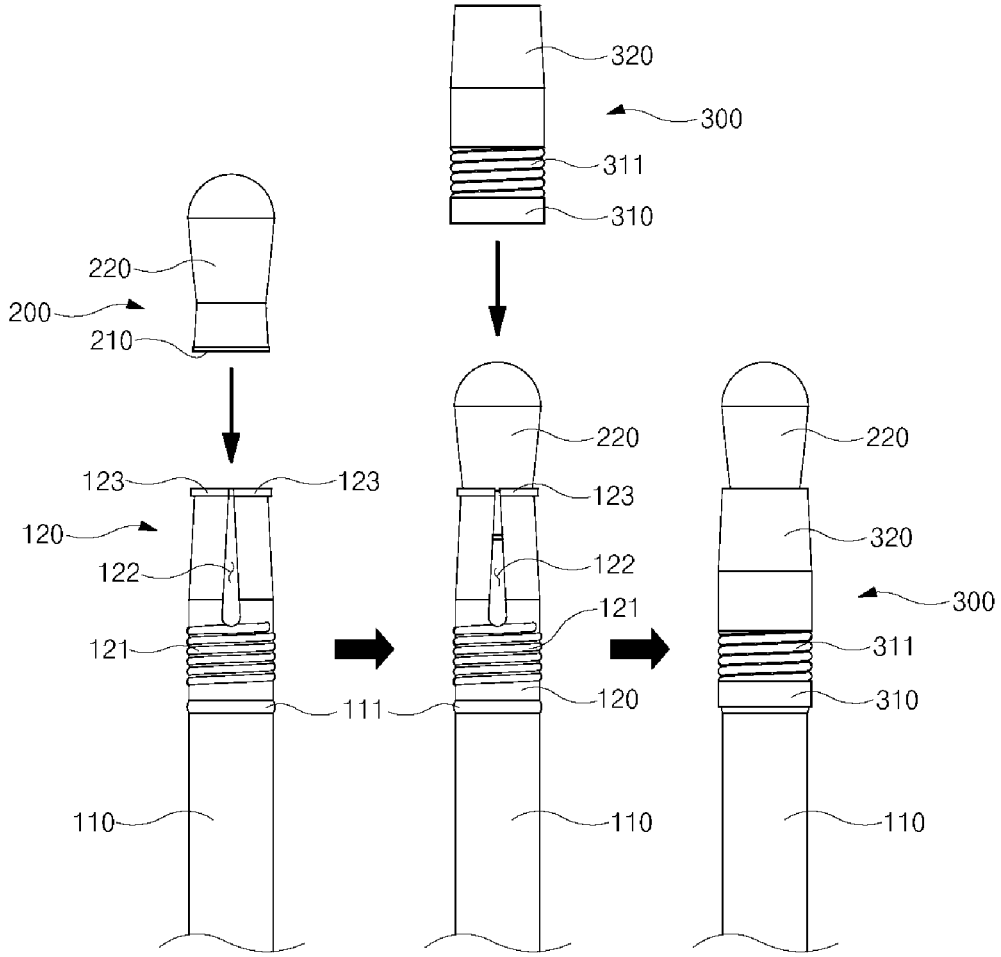
FIG. 5 is a coupling flowchart of the exemplary embodiment illustrated in FIG. 1.

FIG. 1 is a diagram schematically illustrating a makeup brush according to an exemplary embodiment of the present disclosure, FIG. 2 is a cross-sectional view of FIG. 1, FIG. 3 is an exploded perspective view of FIG. 1, FIG. 4 is an enlarged view of an area of a coupling body illustrated in FIG. 3, and FIG. 5 is a coupling flowchart of the exemplary embodiment illustrated in FIG. 1.

As illustrated in the drawings, the makeup brush 1 according to the exemplary embodiment includes a brush body 100, a brush bristle part, which is coupled to the brush body 100 and has bristle members 220; and a connection fixing part 300 having one side portion coupled to the brush body 100, and having the other side portion supporting the bristle members 220.

As illustrated in FIG. 2, the brush body 100 serves as a connection location for the brush bristles 200 and the connection fixing part 300, and may also serve as a user's handle.

In the exemplary embodiment, the brush body 100 includes a handle body 110, and a coupling body 120 which is provided integrally with the upper portion of the handle body 110, and provided as a coupling location of the brush bristle part 200 and the connection fixing portion 300 as illustrated in FIG. 3.

The handle body 110 of the brush body 100 is provided as a user's handle and, as illustrated in FIG. 1, may have a round bar shape.

In the exemplary embodiment, the handle body 110 may be made of a metal material, for example, a material containing aluminum. In the exemplary embodiment, the handle body 110 may also be made of a material containing synthetic resin.

Additionally, in the exemplary embodiment, a protrusion 111 is provided on the outer wall of the handle body 110, as illustrated in FIG. 3, and the lower end of a first fixing body 310 may be supported on the protrusion 111.

The coupling body 120 of the brush body 100 may be provided integrally with the handle body 110 at the upper end of the handle body 110, and the brush bristle part 200 may be detachably coupled to the upper side portion, and may be detachably screwed to the outer wall.

In the exemplary embodiment, the outer wall of the coupling body 120 is provided with a first screw thread 121, as illustrated in FIG. 3, and in the exemplary embodiment, the first screw thread 121 may be screwed to a second screw thread 311 provided in a second fixing body 320 of the connection fixing part 300.

Further, in the exemplary embodiment, as illustrated in FIG. 3, a first cut part 122 may be provided at the upper side portion of the coup-ling body 120. In the exemplary embodiment, the first cut part 122 allows the area of the coupling body 120 provided with the first cut part 122 to be easily opened when the brush bristle part 200 is inserted and coupled to the coupling body 120, thereby being easily coupled to the brush bristles 200. Additionally, in the exemplary embodiment, the first cut part 122 may press the brush bristle part 200 to which the coupling body 120 is coupled. In the exemplary embodiment, as illustrated in FIG. 4, the first cut part 122 may be narrow at the upper end and gradually widen toward the lower end. In the exemplary embodiment, a plurality of first cut parts 122, for example, three, may be provided, and each first cut part 122 may be arranged at equal intervals.

Furthermore, in the exemplary embodiment, as illustrated in FIG. 4, a first step part 123 may be provided at the upper end of the coupling body 120. In the exemplary embodiment, the inner wall of the first step part 123 may support the bristle member 220, as illustrated in FIG. 2, and the outer wall has a second fixing body 320 of the connection fixing part 300, and an upper inner wall of the second fixing body of the connection fixing body 300 may be supported on the outer wall. In the exemplary embodiment, the first step part 123 may be separated into a plurality of pieces, for example three, by the first cut part 122, as illustrated in FIG. 4.

As illustrated in A and B of FIG. 5, the brush bristle part 200 may be fitted and coupled to the upper part of the coupling body 120 provided with the first cut part 122, and a bottom portion of the brush bristle part 200 may be supported on the upper surface portion of the handle body 110, as illustrated in FIG. 2.

In the exemplary embodiment, the brush bristle part 200 includes a flange member 210 whose bottom portion is supported on the upper surface portion of the handle body 110 and whose edge is pressed by the inner wall of the coupling body 120, as illustrated in FIG. 2, and a plurality of bristle members 220 provided on the upper surface portion of the flange member 210 and supported by the inner wall of the first step part 123.

In the exemplary embodiment, when replacing the brush bristle part 200, the connection fixing part 300 is separated and the brush bristle part 200 is pulled upward, and the coupling body 120 is extended by the plurality of first cut parts 122, and the brush bristle part 200 may be easily replaced.

The lower ends of the plurality of bristle members 220 of the brush bristle part 200 may be coupled to the upper surface portion of the flange member 210 by thermal fusion. In the exemplary embodiment, the plurality of bristle members 220 may also be coupled to the flange member 210 using an adhesive that is harmless to the human body.

As illustrated in FIG. 2, the connection fixing part 300 is coupled to the coupling body 120 to encompass the coupling body 120 and presses the first step part 123, which is the upper end portion of the coupling body 120.

In the exemplary embodiment, the connection fixing part 300 includes a first fixing body 310 that is screwed to the first screw thread 121 of the coupling body 120 by the second screw thread 311, and a second fixing body 320 provided on the upper part of the first fixing body 310 to press the first step part 123 as illustrated in FIG. 2.

In this embodiment, the first fixing body 310 may have a cylindrical shape with a constant diameter, as illustrated in FIG. 3, and the second fixing body 320 is integrated with the upper end portion of the first fixing body 310, and may have a cylindrical shape with a diameter that gradually decreases toward the upper end portion.

In the exemplary embodiment, the connection fixing body 300 may be made of a material including metal, synthetic resin, or wood.

Hereinafter, a coupling sequence of the exemplary embodiment will be described with reference to FIG. 5.

First, as illustrated in A of FIG. 5, the lower portion of the brush bristle part 300 is placed in an upper region of the coupling body 120, and then the upper region of the coupling body 120 is extended and then, as illustrated in B of FIG. 5, the brush bristle part 200 is coupled to the coupling body 120.

Next, the connection fixing part 300 is placed on the upper portion of the brush bristle part 200 so that the first fixing body 310 is disposed at the lower portion, and then a work of coupling the connection fixing part 300 to the coupling body is completed through the second screw thread 311 of the connection fixing part 300 and the first screw thread 121 of the coupling body 120.

Figure 6:
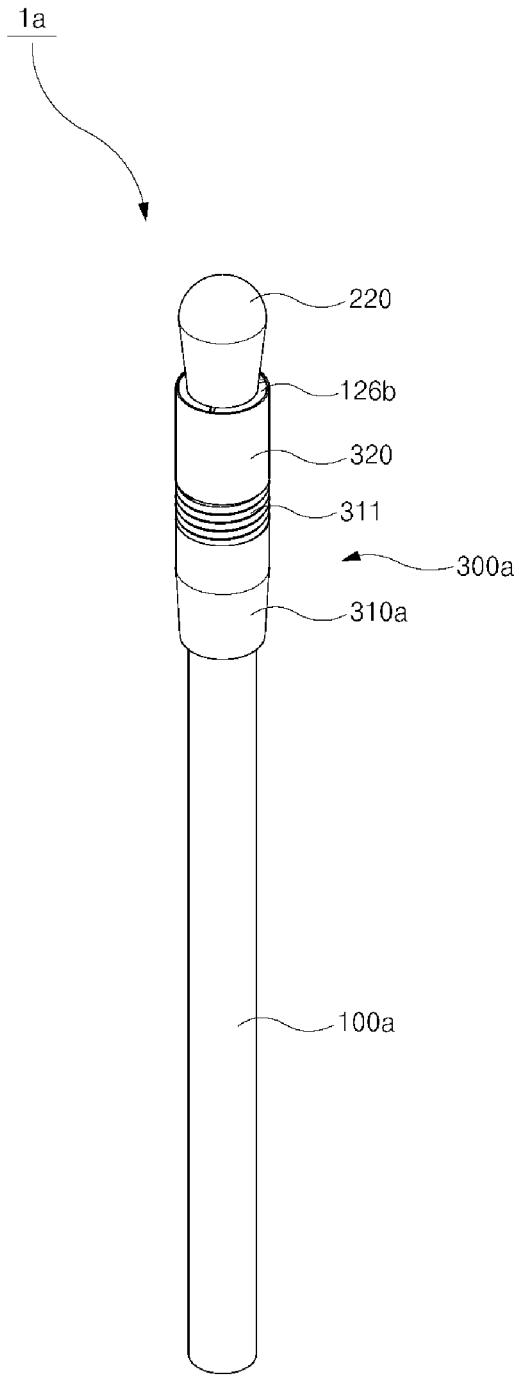
FIG. 6 is a diagram schematically illustrating a makeup brush according to another embodiment of the present disclosure.
Figure 7:
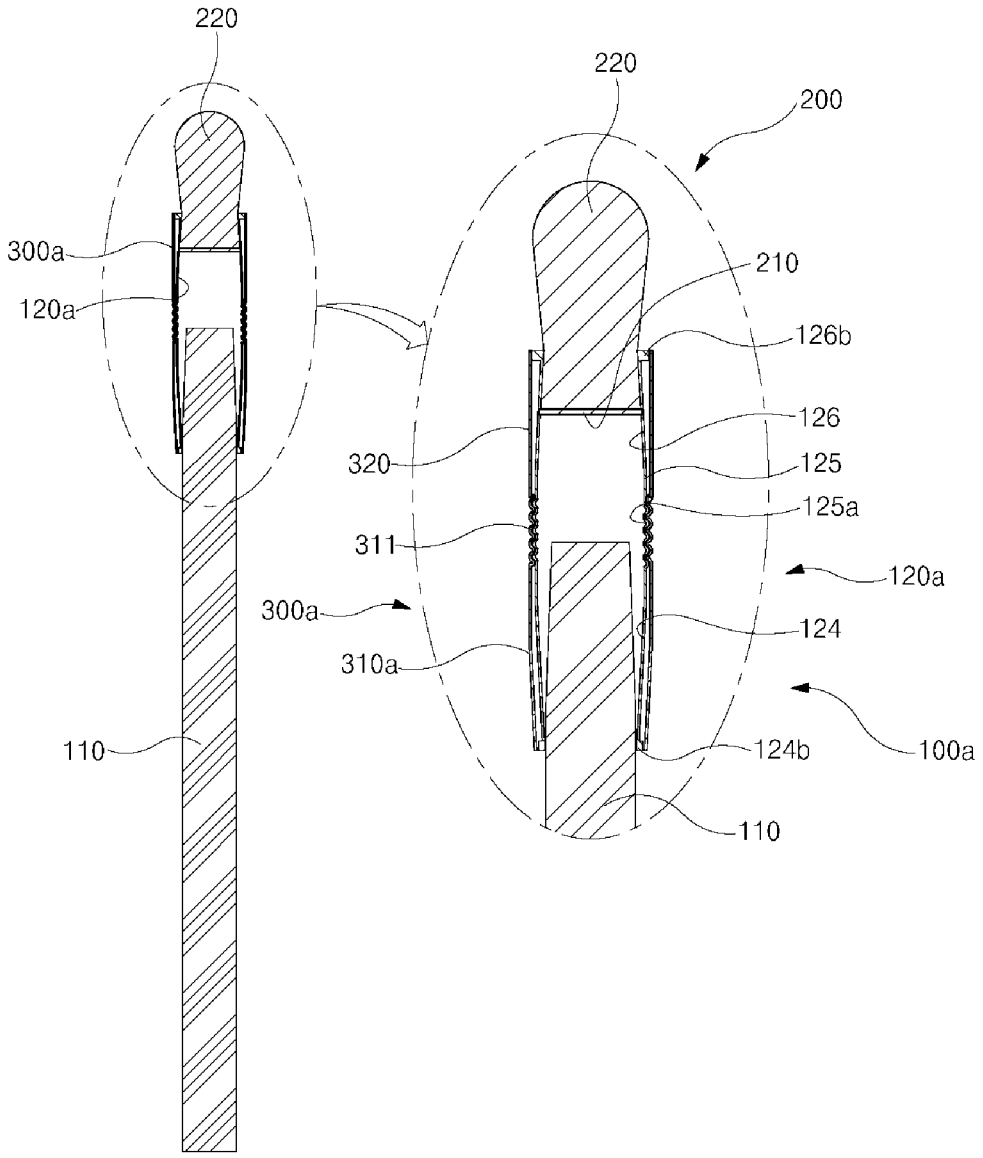
FIG. 7 is a cross-sectional view of FIG. 6.
Figure 8:
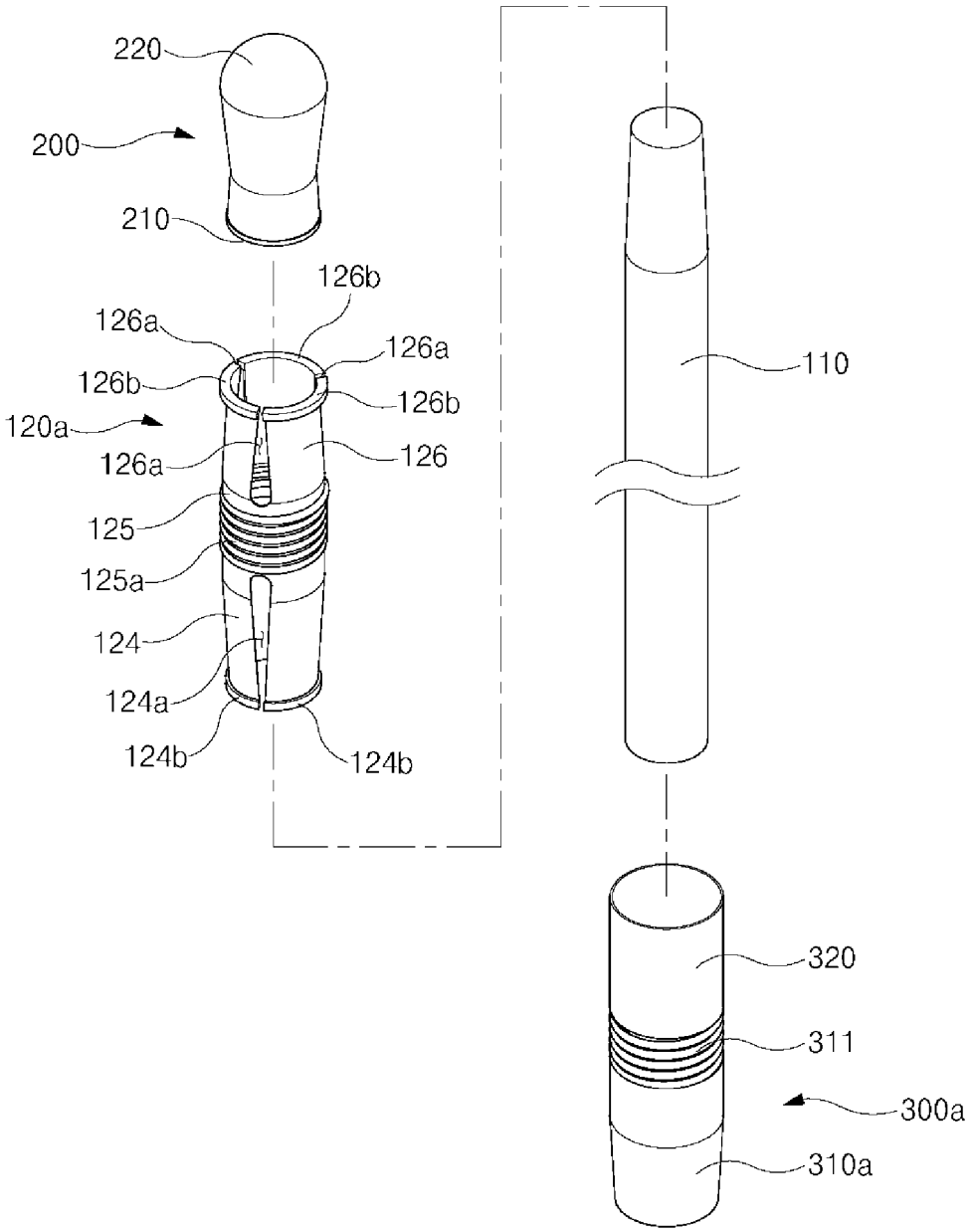
FIG. 8 is an exploded perspective view of FIG. 6.
Figure 9:
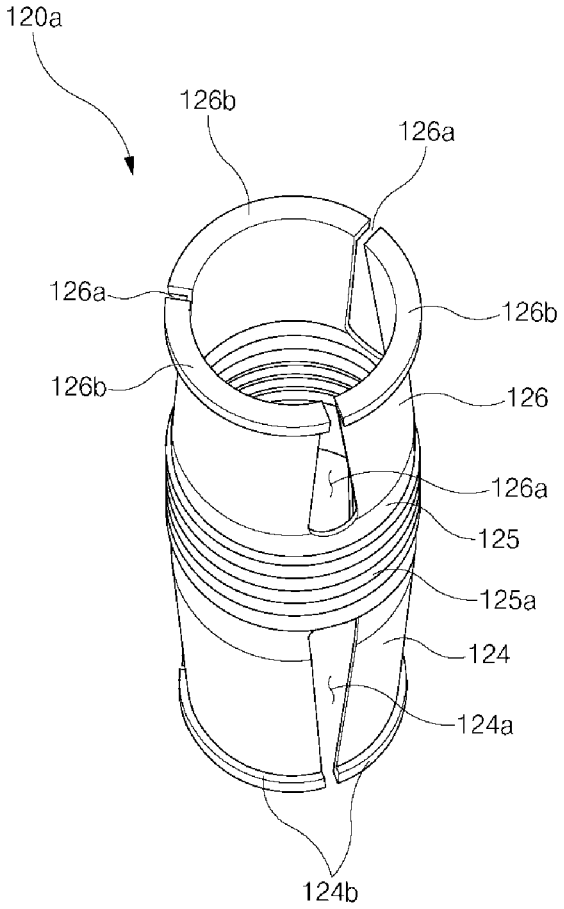
FIG. 9 is a diagram illustrating a coupling body illustrated in FIG. 8.
Figures 10A, 10B, 10C, 10D:
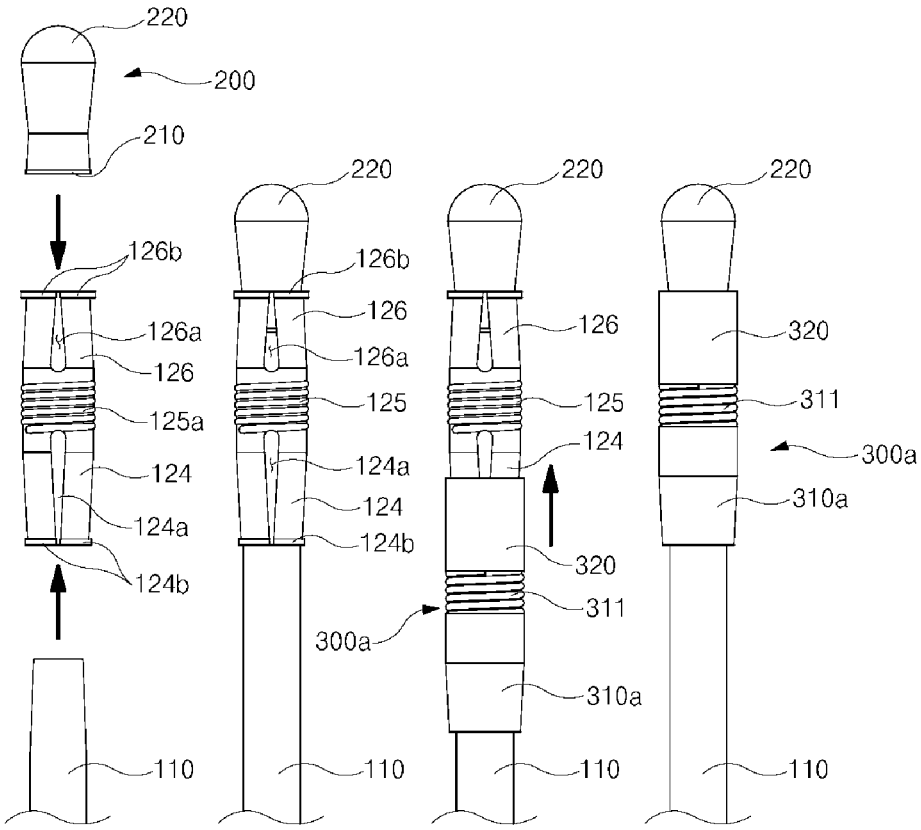
FIG. 10 is a coupling flowchart of the exemplary embodiment illustrated in FIG. 6.

FIG. 6 is a diagram schematically illustrating a makeup brush according to another embodiment of the present disclosure, FIG. 7 is a cross-sectional view of FIG. 6, FIG. 8 is an exploded perspective view of FIG. 6, FIG. 9 is a diagram illustrating a coupling body illustrated in FIG. 8, and FIG. 10 is a coupling flowchart of the exemplary embodiment illustrated in FIG. 6.

The makeup brush 1*a* according to the exemplary embodiment includes a brush body 100*a*, a brush bristle part 200 coupled to the brush body 100*a* and provided with bristle members 220, and a connection fixing part 300*a* having one side portion coupled to a coupling body 120*a* of the brush body 100*a* and the other side portion provided to press an upper portion of the coupling body 120*a* and encompass the coupling body 120*a*.

As illustrated in FIG. 7, the brush body 100*a* serves as a connection location for the brush bristles 200 and the connection fixing part 300*a*, and may also serve as a user's handle.

In the exemplary embodiment, the brush body 100*a* includes a handle body 110, and a coupling body 120*a* which is detachably coupled to the upper portion of the handle body 110 and provided as a coupling location of the brush bristle part 200 and the connection fixing part 300*a* as illustrated in FIG. 8. the exemplary embodiment differs from the above-described embodiment in that the coupling body 120*a* is detachably coupled to the handle body 110.

The handle body 110 of the brush body 100*a* is provided as a user's handle and, as illustrated in FIG. 8, may have a round bar shape, and an upper area may be provided to have a smaller diameter than other areas.

In the exemplary embodiment, the handle body 110 may be made of a material including wood.

The coupling body 120*a* of the brush body 100*a* may be detachably coupled to the upper end portion of the handle body 110, and the brush bristle part 200 may be detachably coupled to the upper side portion, and the connection fixing part 300*a* may be detachably screwed to the outer wall.

In this embodiment, the coupling body 120*a* includes a first body which is coupled to the upper portion of the handle body 110, a screw thread body 125 coupled to the upper portion of the first body 124, and having a third screw thread 125*a* provided on an outer wall, and screwed to the second screw threads 311 of the connection fixing part 300*a*, and a second body 126 provided at the upper portion of the screw thread body 125, having an inner wall to which the brush bristle part 200 is coupled, and an outer wall to which the second fixing body 320 of the connection fixing part 300*a* is coupled as illustrated in FIGS. 8 and 9.

The first body 124 of the coupling body 120*a* may be detachably coupled to the upper portion of the handle body 110, and the first body 124 may have a plurality of second cut parts 124*a* as illustrated in FIG. 8. In the exemplary embodiment, the plurality of second cut parts 122 may allow the area of the coupling body 110 provided with the first cut part 122 to be extended to be easily coupled when coupling the coupling body 120*a* to the handle body 110. In the exemplary embodiment, the plurality of second cut parts 124*a* may be provided in the same shape and number as the plurality of first cut parts 122 described above.

Further, in the exemplary embodiment, as illustrated in FIG. 8, a plurality of second step parts 124*b* may be provided at the lower end portion of the first body 124. In the exemplary embodiment, as illustrated in FIG. 7, an inner wall of the first fixing body 310*a* may be supported on outer walls of the plurality of second step parts 124*b*. In the exemplary embodiment, the plurality of second step parts 124*b* may be provided in the same shape and number as the first step parts 123 described above.

The second body 126 of the coupling body 120*a* may be provided as a coupling location of the brush bristle part 200, and a third cut part 126*a* may be provided at an upper side portion of the second body 126 as illustrated in FIGS. 8 and 9. In the exemplary embodiment, the third cut part 126*a* allows the area of the coupling body 120 provided with the first cut part 122 to be easily opened when the brush bristle part 200 is inserted and coupled to the coupling body 120, thereby being easily coupled to the brush bristles 200. Additionally, in the exemplary embodiment, the third cut part 122 may press the brush bristle part 200 to which the coupling body 120*a* is coupled. In the exemplary embodiment, the third cut part 126*a* may be provided in the same shape and number as the first cut parts 122 described above.

In the exemplary embodiment, as illustrated in FIG. 9, a third step part 126*b* may be provided at the upper end portion of the second body 126. In the exemplary embodiment, the third step parts 126*b* may be provided in the same shape and number as the first step parts 123 described above.

The connection fixing part 300*a* different from that of the above-described embodiment in that the connection fixing part 300*a* includes a first fixing body 310*a* and a second fixing body 320, and lengths of the first fixing body 310*a* and the second fixing body 320 are the same as or similar to each other as illustrated in FIG. 8.

Hereinafter, a coupling sequence of the exemplary embodiment will be described with reference to FIG. 10.

First, as illustrated in A of FIG. 10, the coupling body 120*a* and the brush bristle part 200 are placed on the upper portion of the handle body 110, and then the first body 124 of the coupling body 120*a* is coupled to the handle body 110, and then the brush bristle part 200 is coupled to the second body 126 of the coupling body 120*a*. In the exemplary embodiment, the brush bristle part 200 may also be coupled to the second body 126 and then the first body 124 may also be coupled to the handle body 110.

Next, the connection fixing part 300*a* is inserted from the lower portion to the upper portion of the handle body 110, as illustrated in C of FIG. 10, and then screwed to the coupling body 120*a* to complete the work.

As described above, the exemplary embodiment can fundamentally block harmful components of adhesives. In addition, the connection fixing part is coupled to the brush body while covering the coupling body, thereby increasing the stability of the coupling. Furthermore, since the brush bristles are detachable from the coupling body, the brush bristles can be easily replaced. In addition, the upper end of the coupling body can support the outside of the plurality of bristle members, thereby preventing the plurality of bristle members from spreading. In addition, the brush bristles, the connection fixing part (metal tube), and the coupling body can be selectively detached, so the consumer can freely change the handle body of a desired color, the brush bristles, and the connection fixing part made of metal, paper, plastic, etc., which can be conveniently separated and collected after use.

As described above, the present disclosure is not limited to the exemplary embodiments described herein, and it would be apparent to those skilled in the art that various changes and modifications might be made without departing from the spirit and the scope of the present disclosure. Therefore, it will be determined that the changed examples or modified examples are included in the appended claims of the present disclosure.

What is claimed is:

1. A makeup brush comprising:

a brush body having a handle body provided as a handle for a user, and a coupling body provided at the handle body;

a brush bristle part, which is coupled to the brush body and has bristle members; and a connection fixing part having one side portion coupled to the coupling body, and having the other side portion pressing an upper portion of the coupling body, wherein the coupling body includes a lower cut part guiding extension and contraction of a coupling area of the coupling body when detachably coupling the coupling body to the handle body, and a upper cut part guiding extension and contraction of the coupling area of the coupling body when detachably coupling the brush bristle part to the coupling body, and the brush bristle part is detachably coupled to the coupling body.

2. The makeup brush of claim 1, wherein the coupling body further includes a first body detachably coupled to the handle body, and having the lower cut part, a screw thread body provided at one side portion of the first body, and a second body provided at one side portion of the screw thread body, detachably coupled to the brush bristle part, and having the upper cut part.

3. The makeup brush of claim 2, wherein the coupling body includes a lower step part provided in the first body, and supporting one inner wall of the connection fixing part, and a upper step part provided in the second body, and supporting the other inner wall of the connection fixing part.

4. The makeup brush of claim 3, wherein a plurality of lower step parts are provided, which are cut by the lower cut part, and a plurality of upper step parts are provided, which are cut by the upper cut part.

* * * * *